US006032321A

United States Patent [19]

Shirey et al.

[11] Patent Number: 6,032,321

[45] Date of Patent: Mar. 7, 2000

[54] WASHING TOOL

[76] Inventors: William Shirey; Jacqueline Schultz-Shirey, both of 6432 Old Rte. 22, Bernville, Pa. 19506

[21] Appl. No.: 09/097,962

[22] Filed: Jun. 16, 1998

[51] Int. Cl.[7] ..... B25G 1/04

[52] U.S. Cl. ..... 15/244.2; 15/144.1; 15/144.4; 15/244.3

[58] Field of Search ..... 15/244.2, 244.1, 15/144.1, 144.4, 220.1, 210.1, 143.1, 244.3

[56] References Cited

U.S. PATENT DOCUMENTS

| | | |
|---|---|---|
| 1,649,951 | 11/1927 | English . |
| 1,656,950 | 1/1928 | Moline . |
| 3,568,237 | 3/1971 | Rhodes . |
| 4,299,005 | 11/1981 | Brown . |
| 5,671,497 | 9/1997 | Abdo . |
| 5,823,592 | 10/1998 | Kalidindi . |

*Primary Examiner*—Robert J. Warden, Sr.
*Assistant Examiner*—Jennifer McNeil

[57] ABSTRACT

A new washing tool for reaching high and remote surfaces of a structure such as a vehicle while washing. The inventive device includes a handle, a shaft and a washing head. The shaft has an extension portion and an adjustable portion. The extension portion of the shaft is inserted into an opening in one end of the handle. The adjustable portion of the shaft has a pair of opposite ends and a plurality of elongate segments. One of the ends of adjustable portion of the shaft is coupled to the extension portion of the shaft. Each segment of the adjustable portion is pivotally coupled to the adjacent segments of the adjustable portion to permit adjustable positioning of the segments of the adjustable portion with respect to the longitudinal axis of the extension portion of the shaft. The washing head has a contact portion and an attachment portion which is pivotally coupled to the other end of the adjustable portion of the shaft.

9 Claims, 2 Drawing Sheets

WASHING TOOL

BACKGROUND OF THE INVENTION

1. Field of the Invention

The present invention relates to washing tools and more particularly pertains to a new washing tool for reaching high and remote surfaces of a structure such as a vehicle while washing.

2. Description of the Prior Art

The use of washing tools is known in the prior art. More specifically, washing tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art washing tools include U.S. Pat. Nos. 4,066,366; 4,182,497; PCT Pat. No. WO 95/02140 (Inventors: Ferreira et al.); U.S. Pat. No. 4,642,834; 2,601,689; U.S. Pat. No. 3,074,088; and EPO Pat. No. EP 0 557 049 A1.

While these devices fulfill their respective, particular objectives and requirements, the aforementioned patents do not disclose a new washing tool. The inventive device includes a handle, a shaft and a washing head. The shaft has an extension portion and an adjustable portion. The extension portion of the shaft is inserted into an opening in one end of the handle. The adjustable portion of the shaft has a pair of opposite ends and a plurality of elongate segments. One of the ends of adjustable portion of the shaft is coupled to the extension portion of the shaft. Each segment of the adjustable portion is pivotally coupled to the adjacent segments of the adjustable portion to permit adjustable positioning of the segments of the adjustable portion with respect to the longitudinal axis of the extension portion of the shaft. The washing head has a contact portion and an attachment portion which is pivotally coupled to the other end of the adjustable portion of the shaft.

In these respects, the washing tool according to the present invention substantially departs from the conventional concepts and designs of the prior art, and in so doing provides an apparatus primarily developed for the purpose of reaching high and remote surfaces of a structure such as a vehicle while washing.

SUMMARY OF THE INVENTION

In view of the foregoing disadvantages inherent in the known types of washing tools now present in the prior art, the present invention provides a new washing tool construction wherein the same can be utilized for reaching high and remote surfaces of a structure such as a vehicle while washing.

The general purpose of the present invention, which will be described subsequently in greater detail, is to provide a new washing tool apparatus and method which has many of the advantages of the washing tools mentioned heretofore and many novel features that result in a new washing tool which is not anticipated, rendered obvious, suggested, or even implied by any of the prior art washing tools, either alone or in any combination thereof.

To attain this, the present invention generally comprises a handle, a shaft and a washing head. The shaft has an extension portion and an adjustable portion. The extension portion of the shaft is inserted into an opening in one end of the handle. The adjustable portion of the shaft has a pair of opposite ends and a plurality of elongate segments. One of the ends of adjustable portion of the shaft is coupled to the extension portion of the shaft. Each segment of the adjustable portion is pivotally coupled to the adjacent segments of the adjustable portion to permit adjustable positioning of the segments of the adjustable portion with respect to the longitudinal axis of the extension portion of the shaft. The washing head has a contact portion and an attachment portion which is pivotally coupled to the other end of the adjustable portion of the shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washing tool apparatus and method which has many of the advantages of the washing tools mentioned heretofore and many novel features that result in a new washing tool which is not anticipated, rendered obvious, suggested, or even implied by any of the prior art washing tools, either alone or in any combination thereof.

It is another object of the present invention to provide a new washing tool which may be easily and efficiently manufactured and marketed.

It is a further object of the present invention to provide a new washing tool which is of a durable and reliable construction.

An even further object of the present invention is to provide a new washing tool which is susceptible of a low cost of manufacture with regard to both materials and labor, and which accordingly is then susceptible of low prices of sale to the consuming public, thereby making such washing tool economically available to the buying public.

Still yet another object of the present invention is to provide a new washing tool which provides in the apparatuses and methods of the prior art some of the advantages thereof, while simultaneously overcoming some of the disadvantages normally associated therewith.

Still another object of the present invention is to provide a new washing tool for reaching high and remote surfaces of a structure such as a vehicle while washing.

Yet another object of the present invention is to provide a new washing tool which includes a handle, a shaft and a washing head. The shaft has an extension portion and an adjustable portion. The extension portion of the shaft is inserted into an opening in one end of the handle. The adjustable portion of the shaft has a pair of opposite ends and a plurality of elongate segments. One of the ends of adjustable portion of the shaft is coupled to the extension portion of the shaft. Each segment of the adjustable portion is pivotally coupled to the adjacent segments of the adjustable portion to permit adjustable positioning of the segments of the adjustable portion with respect to the longitudinal axis of the extension portion of the shaft. The washing head has a contact portion and an attachment portion which is pivotally coupled to the other end of the adjustable portion of the shaft.

Still yet another object of the present invention is to provide a new washing tool that allows a user to reach the top surfaces of minivans and other large vehicles such as sports utility vehicles while cleaning without having to use a step stool.

Even still another object of the present invention is to provide a new washing tool that has an adjustably positionable shaft for aiding the reaching of remote surfaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
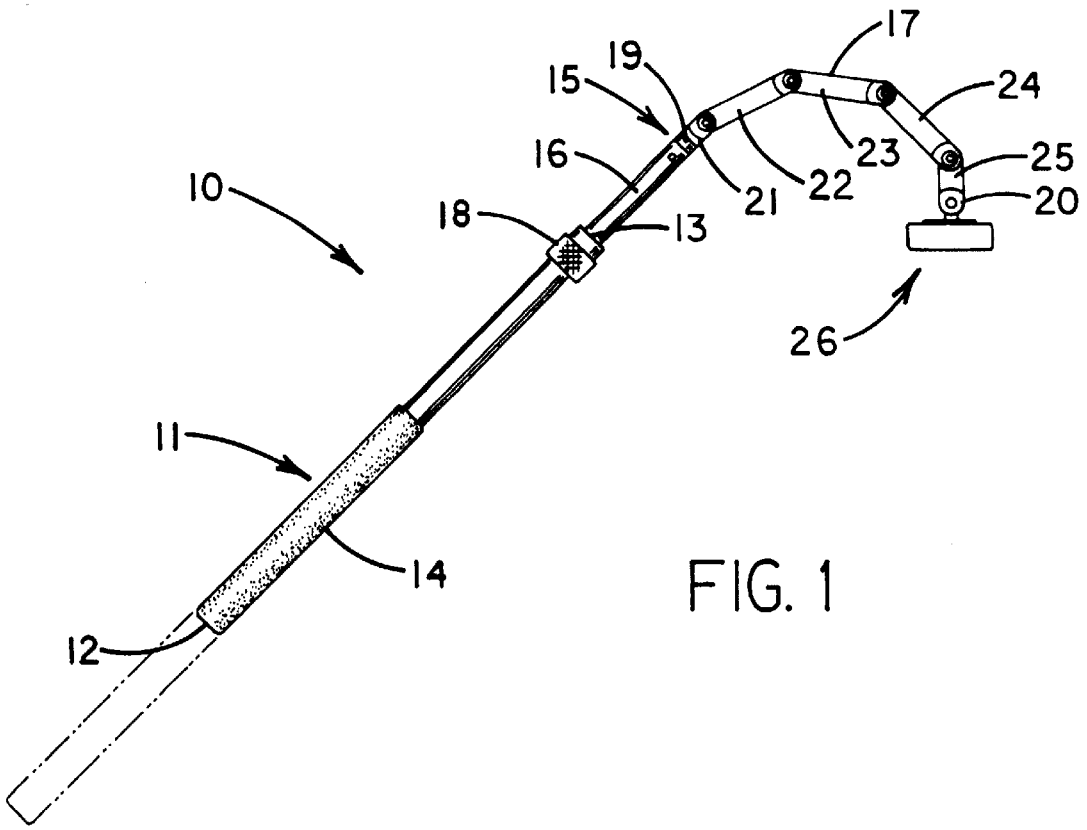
FIG. 1 is a schematic side view of a new washing tool according to the present invention.
Figure 2:
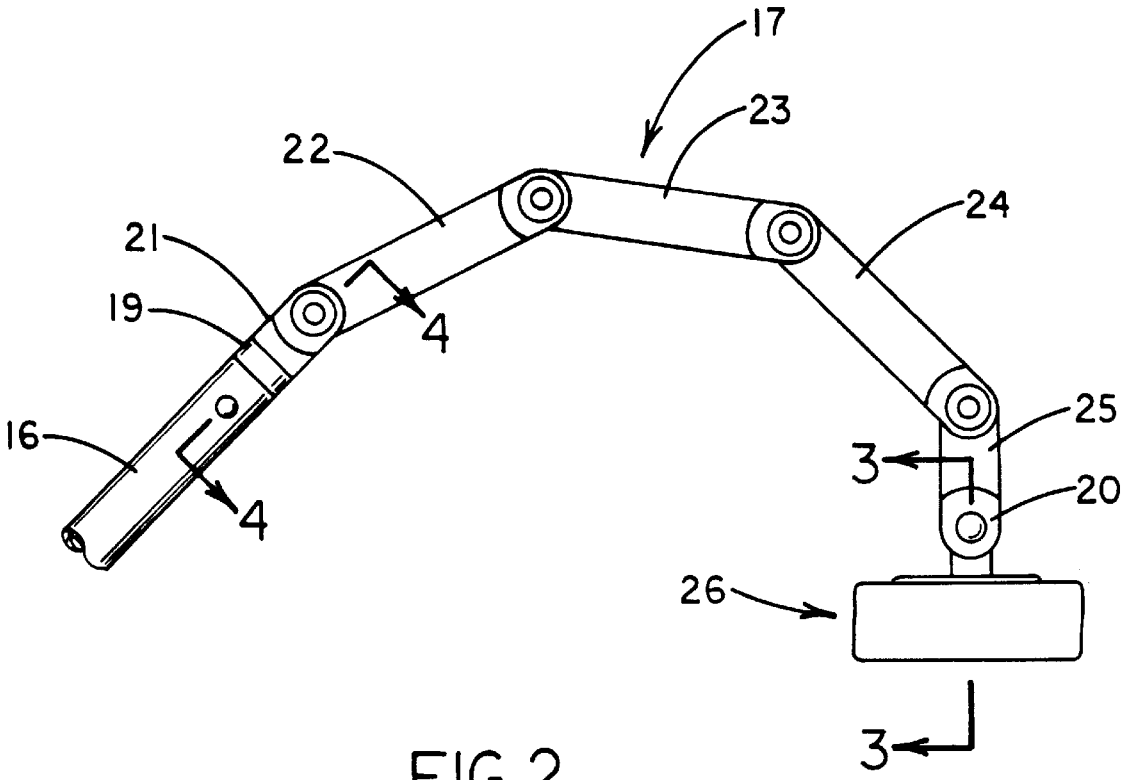
FIG. 2 is a schematic side view of the adjustment portion of the shaft of the present invention.
Figure 3:
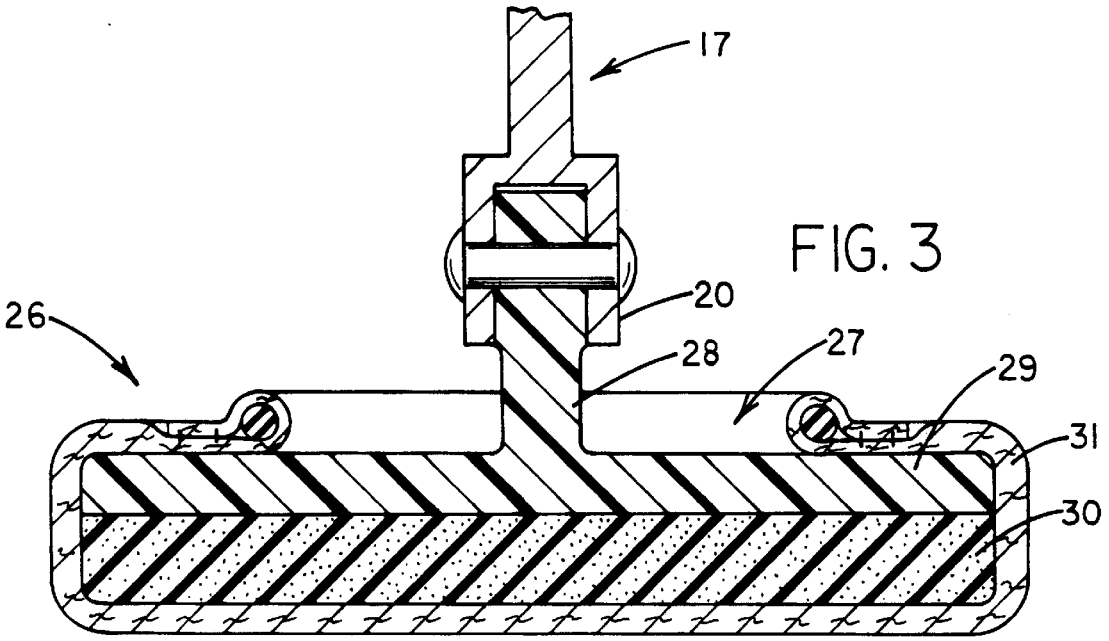
FIG. 3 is a schematic cross sectional view of the washing head of the present invention taken from line 3—3 of FIG. 2.

With reference now to the drawings, and in particular to FIGS. 1 through 6 thereof, a new washing tool embodying the principles and concepts of the present invention and generally designated by the reference numeral 10 will be described.

As best illustrated in FIGS. 1 through 6, the washing tool 10 generally comprises a handle 11, a shaft 15 and a washing head 26. The shaft 15 has an extension portion 16 and an adjustable portion 17. The extension portion 16 of the shaft 15 is inserted into an opening in one end 13 of the handle 11. The adjustable portion 17 of the shaft 15 has a pair of opposite ends 19,20 and a plurality of elongate segments 21,22,23,24,25. One of the ends 19 of adjustable portion 17 of the shaft 15 is coupled to the extension portion 16 of the shaft 15. Each segment of the adjustable portion 17 is pivotally coupled to the adjacent segments 21,22,23,24,25 of the adjustable portion 17 to permit adjustable positioning of the segments 21,22,23,24,25 of the adjustable portion 17 with respect to the longitudinal axis of the extension portion 16 of the shaft 15. The washing head 26 has a contact portion 27 and an attachment portion 28 which is pivotally coupled to the other end 20 of the adjustable portion 17 of the shaft 15.

In closer detail, the elongate handle 11 of the washing tool 10 is generally cylindrical and has a pair of opposite ends 12,13. The handle 11 is designed for gripping by the hands of a user. One of the ends 13 of the handle 11 has an opening therein. Preferably, the handle 11 has an exterior sleeve 14 therearound adjacent the lower end 12 of the handle 11. The sleeve 14 is designed for aiding the grip of a user holding on to the handle 11. The exterior sleeve 14 of the handle 11 comprises a resiliently compressible material, ideally, a foamed material such as a foamed rubber.

Figure 5:
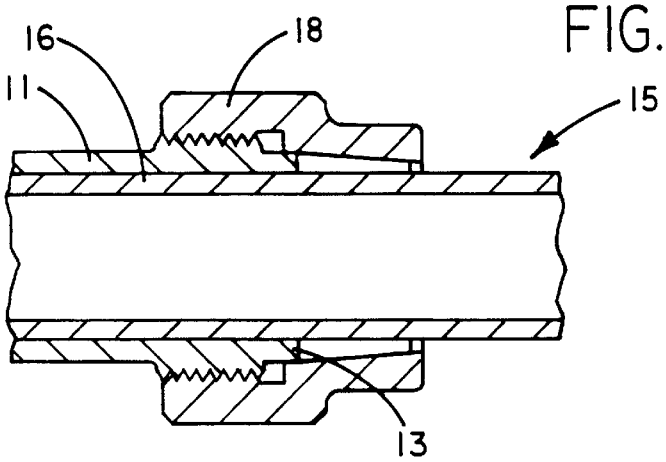
FIG. 5 is a schematic sectional view of the handle and extension portion of the shaft of the present invention.

The elongate shaft 15 has an extension portion 16 and an adjustable portion 17. The extension portion 16 of the shaft 15 has a longitudinal axis and is telescopically inserted into the opening of the one end 13 of the handle 11 for permitting adjustable extension and retraction of the length of the shaft 15 to suit the needs of the user during use. Preferably as illustrated in FIG. 5, a holding ring 18 or collet is disposed around the handle 11 adjacent the one end of the handle 11. The holding ring 18 is designed for holding the extension portion 16 of the shaft 15 in a position with respect to the one end of the handle 11.

Figure 4:
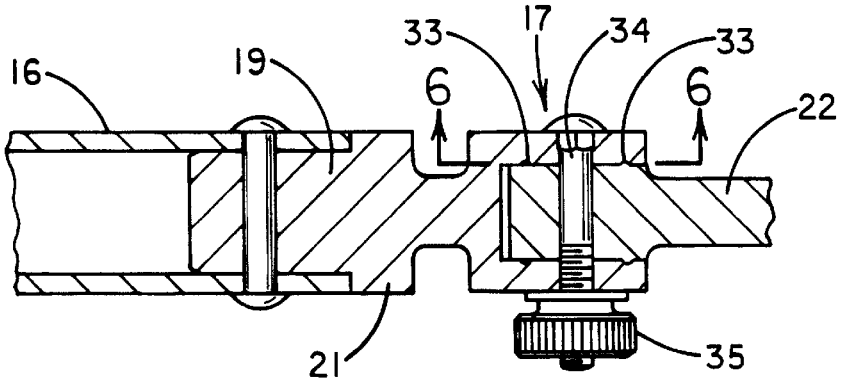
FIG. 4 is a schematic cross sectional view of the present invention taken from line 4—4 of FIG. 2.
Figure 6:
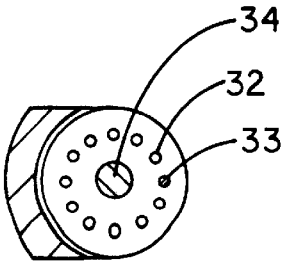
FIG. 6 is a schematic sectional view of the present invention taken from line 6—6 on FIG. 4.

The adjustable portion 17 of the shaft 15 has a pair of opposite ends 19,20 and a plurality of elongate segments 21,22,23,24,25 arranged in a linear series along the length of the adjustable portion 17 between the ends 19,20 of the adjustable portion 17. As illustrated in FIG. 4, the lower end 19 of the adjustable portion 17 of the shaft 15 is coupled to the extension portion 16 of the shaft 15. Each segment of the adjustable portion 17 is pivotally coupled to the adjacent segments 21,22,23,24,25 of the adjustable portion 17 to permit adjustable positioning of the segments 21,22,23,24,25 of the adjustable portion 17 with respect to the longitudinal axis of the extension portion 16 of the shaft 15. Preferably, as illustrated in FIGS. 4 and 6, each pivotal coupling between adjacent segments 21,22,23,24,25 comprises a plurality of detents 32 on one of the adjacent segments and a plurality of projections 33 on the other of the adjacent segments. The projections 33 are insertable into the detents 32 to help hold the adjacent segments in a position with respect to one anther. Each of the pivotal couplings also includes a threaded fastener 34 extended through the adjacent segments with a finger turning nut 35. The threaded fastener is designed for helping hold the adjacent segments 21,22,23,24,25 in a position with respect to one another.

The washing head 26 has a contact portion 27 and an attachment portion 28. The attachment portion 28 of the washing head 26 is pivotally coupled to the other end 20 of the adjustable portion 17 of the shaft 15. The contact portion 27 is designed for scrubbing and wiping on a surface such as the top of a minivan during the washing of the surface. The contact portion 27 of the washing head 26 has a generally flat pad base 29 coupled to the attachment portion 28 of the washing head 26. The pad base 29 ideally comprises a generally rigid plastic. The contact portion 27 of the washing head 26 also has a washing pad 30. The washing pad 30 is coupled to the pad base 29 preferably by an adhesive. The washing pad 30 is designed for contact with the surface being washed. The washing pad 30 preferably comprises a resiliently compressible material, ideally, a foamed material so that the washing pad 30 does not scratch or damage the surface being washed and can hold cleaning fluid such as soapy water therein. The pad base 29 is designed for providing support to the washing pad 30 when using the washing pad 30 on the surface being washed. The contact portion 27 of the washing head 26 also preferably has a flexible soft fabric bonnet 31 covering the wash pad and the wash base of the contact portion 27. The bonnet 31 has an elastic lined opening to permit quick and easy covering and uncovering of the contact portion 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A washing tool, comprising:

an elongate handle having a pair of opposite ends, one of said ends of said handle having an opening therein;

an elongate shaft having an extension portion and an adjustable portion;

said extension portion of said shaft having a longitudinal axis and being inserted into said opening of said one end of said handle;

said adjustable portion of said shaft having a pair of opposite ends and a plurality of elongate segments;

one of said ends of adjustable portion of said shaft being coupled to said extension portion of said shaft;

each segment of said adjustable portion being pivotally coupled to the adjacent segments of said adjustable portion to permit adjustable positioning of said segments of said adjustable portion with respect to said longitudinal axis of said extension portion of said shaft; and a washing head having a contact portion and an attachment portion, said attachment portion of said washing head being pivotally coupled to another of said ends of said adjustable portion of said shaft, said contact portion of said washing head having a pad base coupled to said attachment portion of said washing head, said contact portion of said washing head having a washing pad coupled to said pad base, an outer perimeter of said pad base being in vertical alignment with an exterior perimeter of said contact portion.

2. The washing tool of claim 1, wherein said handle has an exterior sleeve therearound adjacent another end of said handle.

3. The washing tool of claim 2, wherein said exterior sleeve of said handle comprises a resiliently compressible material.

4. The washing tool of claim 3, wherein said resiliently compressible material comprises a foamed material.

5. The washing tool of claim 1, wherein each pivotal coupling between adjacent segments comprises a plurality of detents on one of the adjacent segments and a plurality of projections on the other of the adjacent segments, said projections being insertable into said detents to help hold said adjacent segments in a position with respect to one another, each of said pivotal couplings further comprising a threaded fastener extended through said adjacent segments.

6. The washing tool of claim 1, wherein said washing pad comprises a resiliently compressible material.

7. The washing tool of claim 6, wherein said resiliently compressible material of said washing pad comprises a foamed material.

8. The washing tool of claim 1, wherein said contact portion of said washing head has a bonnet covering said wash pad and said wash base of said contact portion.

9. A washing tool, comprising:

an elongate handle being generally cylindrical and having a pair of opposite ends, one of said ends of said handle having an opening therein, said handle having an exterior sleeve therearound adjacent another end of said handle, said exterior sleeve of said handle comprises a resiliently compressible material, wherein said resiliently compressible material comprises a foamed material;

an elongate shaft having an extension portion and an adjustable portion;

said extension portion of said shaft having a longitudinal axis and being telescopically inserted into said opening of said one end of said handle;

said adjustable portion of said shaft having a pair of opposite ends and a plurality of elongate segments;

one of said ends of adjustable portion of said shaft being coupled to said extension portion of said shaft;

each segment of said adjustable portion being pivotally coupled to the adjacent segments of said adjustable portion to permit adjustable positioning of said segments of said adjustable portion with respect to said longitudinal axis of said extension portion of said shaft;

wherein each pivotal coupling between adjacent segments comprises a plurality of detents on one of the adjacent segments and a plurality of projections on the other of the adjacent segments, said projections being insertable into said detents to help hold said adjacent segments in a position with respect to one another, each of said pivotal couplings further comprising a threaded fastener extended through said adjacent segments;

a washing head having a contact portion and an attachment portion, said attachment portion of said washing head being pivotally coupled to another of said ends of said adjustable portion of said shaft;

said contact portion of said washing head having a generally flat pad base coupled to said attachment portion of said washing head;

said contact portion of said washing head having a washing pad, said washing pad being coupled to said pad base, an outer perimeter of said pad base being in vertical alignment with an exterior perimeter of said contact portion, said washing pad comprising a resiliently compressible material, wherein said resiliently compressible material of said washing pad comprises a foamed material; and said contact portion of said washing head having a bonnet covering said wash pad and said wash base of said contact portion.

* * * * *